US008746400B2

(12) United States Patent
Maejima et al.

(10) Patent No.: US 8,746,400 B2
(45) Date of Patent: Jun. 10, 2014

(54) EXHAUST DEVICE OF ENGINE

(71) Applicant: Suzuki Motor Corporation, Hamamatsu (JP)

(72) Inventors: Hiroyuki Maejima, Hamamatsu (JP); Kazutoshi Baba, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 13/661,006

(22) Filed: Oct. 25, 2012

(65) Prior Publication Data

US 2013/0112498 A1 May 9, 2013

(30) Foreign Application Priority Data

Oct. 27, 2011 (JP) ..... 2011-236330

(51) Int. Cl.

| | |
|---|---|
| ***F01N 13/08*** | (2010.01) |
| ***F01N 1/02*** | (2006.01) |
| ***F01N 1/10*** | (2006.01) |
| ***F01N 1/24*** | (2006.01) |

(52) U.S. Cl.

USPC ..... 181/228; 181/227; 181/251; 181/252; 181/256

(58) Field of Classification Search

USPC ..... 181/228, 227, 251, 252, 256

See application file for complete search history.

(56) References Cited

U.S. PATENT DOCUMENTS

| | | | | |
|---|---|---|---|---|
| 1,387,614 | A * | 8/1921 | Reid | 181/253 |
| 2,877,860 | A * | 3/1959 | Hoffar | 181/246 |
| 3,196,977 | A * | 7/1965 | Sanders | 181/256 |
| 4,192,402 | A * | 3/1980 | Nakagawa et al. | 181/256 |
| 4,290,501 | A * | 9/1981 | Tanaka | 181/228 |
| 5,371,331 | A * | 12/1994 | Wall | 181/227 |
| 5,892,186 | A * | 4/1999 | Flugger | 181/252 |
| 6,571,910 | B2 * | 6/2003 | Storm | 181/264 |
| 7,174,992 | B2 * | 2/2007 | Kicinski | 181/255 |
| 7,445,083 | B2 * | 11/2008 | Wu | 181/269 |
| 7,942,236 | B2 * | 5/2011 | Hagiwara | 181/252 |
| 8,002,081 | B2 * | 8/2011 | Honma et al. | 181/256 |
| 8,127,887 | B2 * | 3/2012 | Terashima et al. | 181/251 |
| 8,151,932 | B2 * | 4/2012 | Inoue | 181/227 |
| 2002/0053483 | A1 * | 5/2002 | Ebinger et al. | 181/227 |
| 2002/0121404 | A1 * | 9/2002 | Storm | 181/228 |
| 2003/0136607 | A1 * | 7/2003 | Kawamata et al. | 181/231 |
| 2007/0227810 | A1 * | 10/2007 | Sakurai et al. | 181/251 |
| 2007/0227811 | A1 * | 10/2007 | Sakurai et al. | 181/256 |

FOREIGN PATENT DOCUMENTS

| | | | |
|---|---|---|---|
| JP | 09-013942 | | 1/1997 |
| JP | 09013942 | A * | 1/1997 |
| JP | 3445875 | | 9/2003 |
| JP | 2011127587 | A * | 6/2011 |

* cited by examiner

*Primary Examiner* — David Warren
*Assistant Examiner* — Christina Russell
(74) *Attorney, Agent, or Firm* — Troutman Sanders LLP

(57) ABSTRACT

An exhaust device of an engine includes an exhaust pipe connected to the engine, a silencer connected to the exhaust pipe and structured of an outer cylinder and an inner cylinder in which plural holes are formed, and a sound absorbing material disposed in a space formed between the inner cylinder and the outer cylinder. The exhaust device further includes a partition wall partitioning the space and supporting the sound absorbing material so that the sound absorbing material does not move in an axial direction of the silencer, and the partition wall includes a continuous hole allowing exhaust gas to flow through an upstream side to a downstream side of the partition wall in the space.

4 Claims, 6 Drawing Sheets

EXHAUST DEVICE OF ENGINE

CROSS-REFERENCE TO RELATED APPLICATION

This application is based upon and claims the benefit of priority of the prior Japanese Patent Application No. 2011-236330, filed on Oct. 27, 2011, the entire contents of which are incorporated herein by reference.

BACKGROUND OF THE INVENTION

1. Field of the Invention

The present invention relates to an exhaust device of an engine in a vehicle such as a motorcycle.

2. Description of the Related Art

An exhaust device of an engine in a vehicle for racing used particularly in a motocross race or the like for example is structurally designed to have reduced weight and suppress decrease in output performance. That is, a main pipe having punching holes is provided through a muffler body, and glass wool as a sound absorbing material is stuffed in the space between the muffler body and the main pipe. A cylindrical member formed by rolling a metallic wire cloth and steel wool is inserted between the main pipe and the glass wool.

Incidentally, noise regulations on engine exhaust sound in this type of vehicle are tightened year after year. Then, reduction in exhaust sound becomes necessary, and as a measure thereof, for example, a structure is employed in which a resistive element such as a punching cone is attached to a front portion in the main pipe or a tail pipe part, so as to lead the energy of sound efficiently to the glass wool.

Patent Document 1: Japanese Patent No. 3445875

However, there is a problem in the above-described structure that the glass wool is displaced forward or backward by receiving the pressure of exhaust gas, where the sound absorbing effect decreases and the exhaust sound increases, or a heat problem occurs such that the temperature of the muffler body increases by the influence of exhaust heat. Moreover, when it is attempted to address the displacement by the glass wool itself, there are a method to use molded wool, a method to wrap with glass wool in a mat form, and the like, but they have a problem of cost increase.

Note that in Patent Document 1, a support member is provided to inhibit movement of the glass wool as a sound absorbing material attached in the muffler.

SUMMARY OF THE INVENTION

The present invention is made in view of such problems, and it is an object thereof to provide an exhaust device of an engine which ensures an effective and appropriate sound absorbing effect while it is relatively inexpensive.

An exhaust device of an engine of the present invention includes an exhaust pipe connected to the engine, a silencer connected to the exhaust pipe and structured of an outer cylinder and an inner cylinder in which plural holes are formed, and a sound absorbing material disposed in a space formed between the inner cylinder and the outer cylinder, wherein the exhaust device further includes a partition wall partitioning the space and supporting the sound absorbing material so that the sound absorbing material does not move in an axial direction of the silencer, and wherein the partition wall includes a continuous hole allowing exhaust gas to flow through an upstream side to a downstream side of the partition wall in the space.

Further, in the exhaust device of the engine of the present invention, the silencer includes a cone tapered toward the upstream side in the inner cylinder.

Further, in the exhaust device of the engine of the present invention, at least the partition wall and the cone are disposed on a more upstream side than a middle of the silencer in an upstream-downstream direction.

Further, in the exhaust device of the engine of the present invention, the partition wall is disposed on an immediately downstream side of a base end side of the tapered shape of the cone.

Further, in the exhaust device of the engine of the present invention, the partition wall is formed of a wire cloth material.

DETAILED DESCRIPTION OF THE PREFERRED EMBODIMENTS

Hereinafter, preferred embodiments of an exhaust device of an engine according to the present invention will be described based on the drawings.

Figure 1:
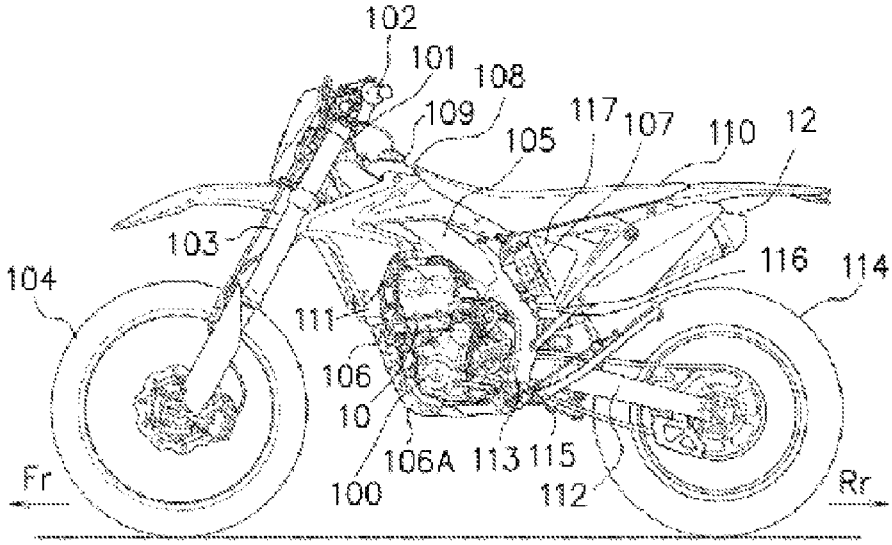
FIG. 1 is a side view illustrating an overall structure of a motorcycle according to the present invention.

FIG. 1 is a side view of a motorcycle according to the present invention. First, the overall structure of the motorcycle will be described using FIG. 1. Note that in the drawings including FIG. 1 which will be used in the following description, the front of the vehicle is denoted by arrow Fr, and the rear of the vehicle is denoted by arrow Rr as necessary. Further, the right side of the vehicle is denoted by arrow R, and the left side of the vehicle is denoted by arrow L as necessary.

The motorcycle of FIG. 1 may typically be what is called an off-road racer, in which a steering head pipe 101 is disposed on a front upper part of the vehicle body thereof, and a not-illustrated steering shaft is inserted rotatably in the steering head pipe 101. A handlebar 102 is fixed to an upper end of the steering shaft, a front fork 103 is attached to a lower end of the steering shaft, and a front wheel 104 which is a steered wheel is supported rotatably on a lower end of the front fork 103.

Figure 2:
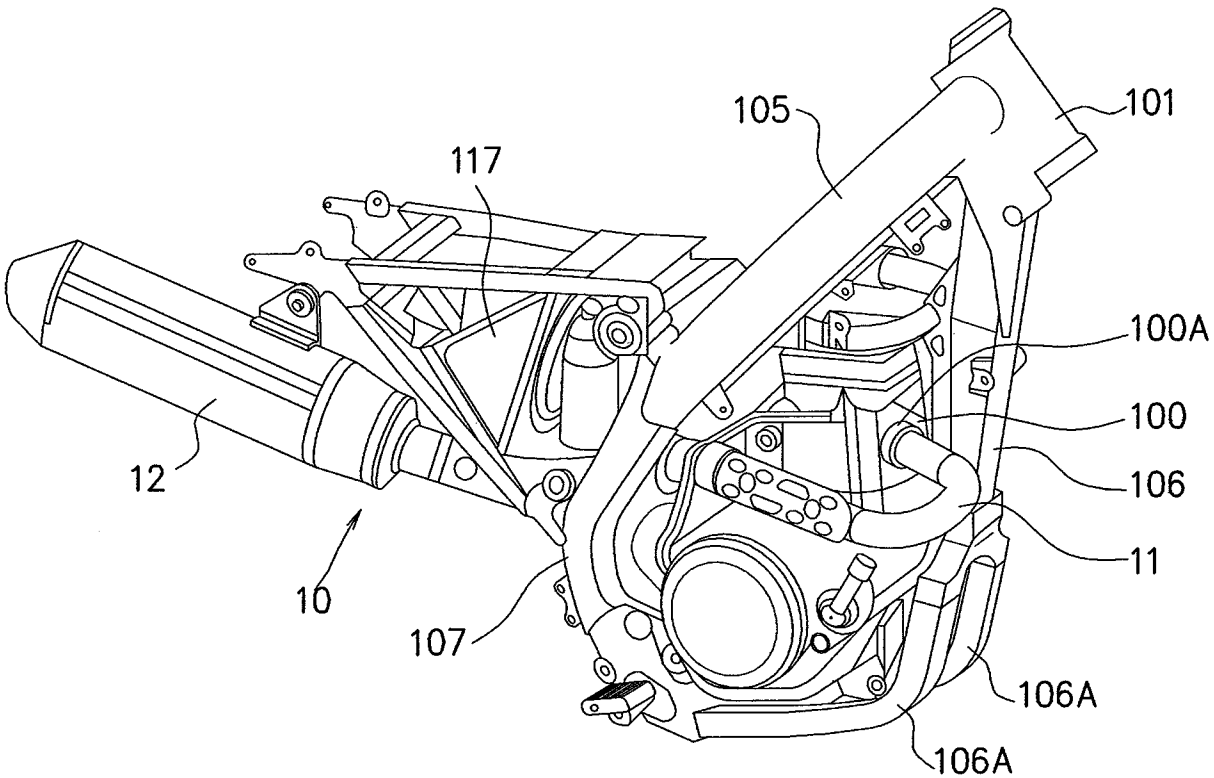
FIG. 2 is a perspective view illustrating a structural example around an engine having an exhaust device of the present invention.

Further, from the steering head pipe 101, a pair of left and right main frames 105 extends obliquely downward toward the rear side of the vehicle body, and a down tube 106 extends downward substantially vertically. Then, the down tube 106 branches to left and right as lower frames 106A from the vicinity of a lower part thereof as illustrated in FIG. 2. After extending downward, this pair of lower frames 106A bends substantially at a right angle toward the rear side of the vehicle body, and rear end portions thereof are coupled to respective rear end portions of the main frames 105 via a pair of left and right body frames 107.

In a space surrounded by the pair of left and right main frames 105, the down tube 106, the lower frames 106A, and the body frames 107, a water-cooled engine 100 as a driving power source is mounted, a fuel tank 108 is disposed above the engine 100, and a fuel supply port thereof is closed with a cap 109. A seat 110 is disposed on a rear side of the fuel tank 108. Further, a radiator 111 is disposed on a front side of the engine 100.

On the pair of left and right body frames 107 provided on a lower side at a substantially center in the forward and backward direction of the vehicle body, a front end portion of a rear swing arm 112 is supported vertically swingably via a pivot shaft 113. On a rear end portion of the swing arm 112, a rear wheel 114 as a driving wheel is supported rotatably. The rear swing arm 112 is suspended on the vehicle body via a link mechanism 115 and a shock absorber 116 (rear suspension device) coupled thereto.

Note that a fuel pump unit is disposed in the fuel tank 108, and fuel is supplied to the engine 100 by this fuel pump unit. On the other hand, on a rear side of the shock absorber 116, an air cleaner box 117 is disposed, and the air cleaner box 117 and the engine 100 are coupled via an intake passage. Note that although being omitted in FIG. 1, the intake passage is connected to an intake port provided in a cylinder head of the engine 100, and a throttle body is disposed as a part of the intake passage in middle thereof. A fuel injector is disposed in this throttle body, and a predetermined amount of fuel is supplied at predetermined timing from the fuel pump unit to the fuel injector.

In this example, the engine 100 is a four-cycle, single-cylinder engine for example, and an exhaust pipe 11 forming an exhaust device 10 according to the present invention is connected to an exhaust port provided in a cylinder head 100A thereof, as illustrated in FIG. 2. The exhaust pipe 11 once extends forward from a front portion of the cylinder head 100A, turns around rightward like a U-turn on the right side of the down tube 106 and further extends backward, and is connected to a silencer (muffler) 12 forming the exhaust device 10. Note that part of the silencer 12 (vicinity of a rear portion) is illustrated in FIG. 1, and this silencer 12 is disposed on a right upper side of the rear wheel 114.

Figure 3:
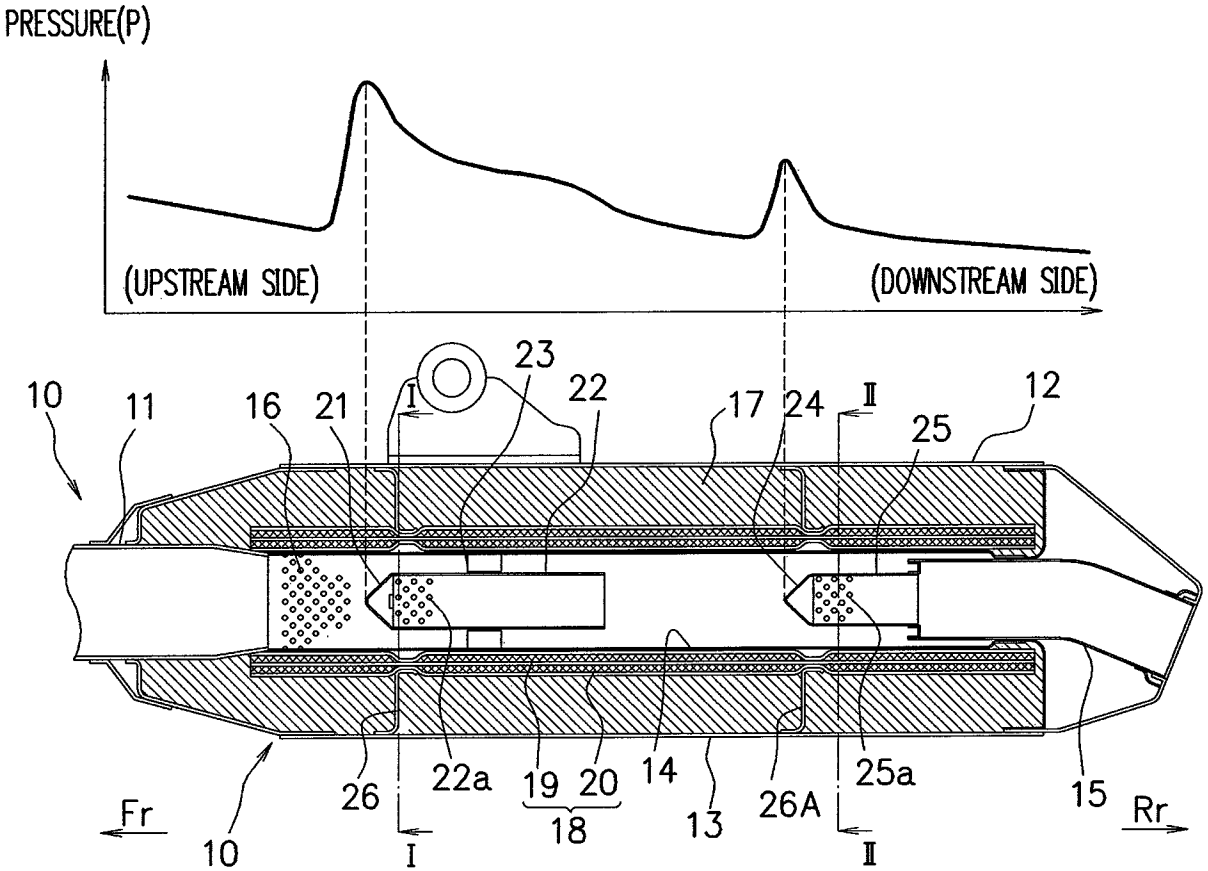
FIG. 3 is a cross-sectional view illustrating an internal structure of a silencer in the exhaust device of the present invention.

FIG. 3 illustrates an internal structure of the silencer 12 in the exhaust device 10 of the present invention. The silencer 12 is structured of an outer cylinder 13 and an inner cylinder 14 housed in the outer cylinder 13 as a substantially concentric double-tubed body, and is mounted on and supported substantially in a forward and backward direction by the body frames. The exhaust pipe 11 is connected to an upstream end of the silencer 12, and a tail pipe 15 is connected to a downstream end thereof. Note that in this embodiment the front Fr side corresponds to an upstream side of flow of exhaust gas, and the rear Rf side corresponds to a downstream side thereof. The exhaust gas flowing into the silencer 12 from the exhaust pipe 11 flows directly into the inner cylinder 14 to form a main flow, and thereafter is exhausted via the tail pipe 15.

Numerous punching holes 16 are formed in the inner cylinder 14. Further, a sound absorbing material 17 formed of glass wool and so on is filled in a space formed between the outer cylinder 13 and the inner cylinder 14. Since the inner cylinder 14 has the punching holes 16, the inside and the outside of the inner cylinder 14 communicate with each other via these punching holes 16. Therefore, part of the exhaust gas introduced from the exhaust pipe 11 into the silencer 12 flows to the outer cylinder 13 side via the punching holes 16 formed in the inner cylinder 14. Then, as the exhaust gas passes through the sound absorbing material 17, the energy of the exhaust gas is reduced, thereby obtaining an exhaust sound absorbing effect.

Figure 4:
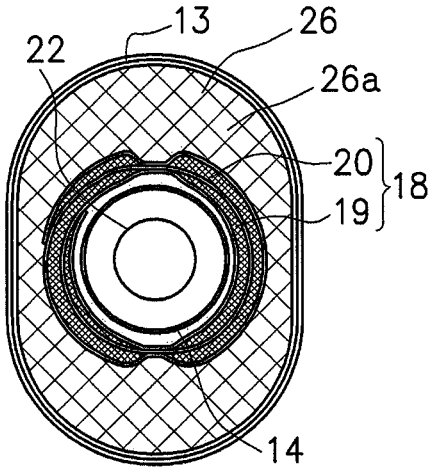
FIG. 4 is a cross-sectional view taken along a line I-I of FIG. 3.
Figure 5:
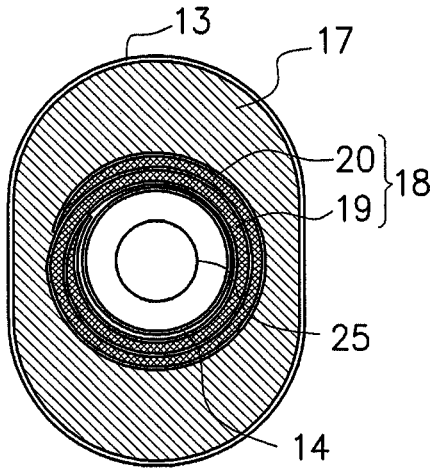
FIG. 5 is a cross-sectional view taken along a line II-II of FIG. 3.

Further, on the outer periphery of the inner cylinder 14, a cylindrical member 18 formed integrally by rolling a metallic wire cloth 19 and steel wool 20 is disposed. This so-called wire cloth is made by weaving metal thin wires like fibers for clothes or the like, and the steel wool is made of iron thin wires formed in a soft cotton-like form. As illustrated in FIG. 4 and FIG. 5, the wire cloth 19 and the steel wool 20 are attached to wrap around the inner cylinder 14. Note that in this example, a cross section of the outer cylinder 13 is not a true circle but is an oval shape, elliptic shape, or the like as illustrated in FIG. 4 or FIG. 5, but is not limited to the illustrated example.

Further, a cone 21 formed to be tapered toward the upstream side is disposed in the inner cylinder 14. The cone 21 generally has a conical shape and has a closed structure, and a cylindrical body 22 is coupled integrally to a base end side of the conical shape. The cylindrical body 22 has numerous punching holes 22*a*, and is fixed concentrically to the inner cylinder 14 with a stay 23. In this example, the cone 21 is disposed on a more upstream side than the middle in the upstream-downstream direction of the silencer 12 as illustrated in FIG. 3. Further, in this embodiment, also a cone 24 is disposed on a more downstream side than the middle in the upstream-downstream direction of the silencer 12. The cone 24 itself is structured to be substantially the same as the cone 21, and is formed to be tapered toward the upstream side. The cone 24 is coupled integrally to a cylinder 25 having numerous punching holes 25*a*, and the cylinder 25 is connected concentrically to a rear end portion (downstream end) of the inner cylinder 14. Note that although the cylindrical body 25 is formed in a stepped shape in this example, it may be one which does not have such a stepped portion.

Further, in the present invention, there is provided a partition wall 26 partitioning the space between the outer cylinder 13 and the inner cylinder 14 and supporting the sound absorbing material 17 in a manner prohibiting movement in an axial direction, that is, the upstream-downstream direction of the silencer 12. This partition wall 26 is formed of a metallic wire-cloth material, and continuous holes 26*a* are provided therein to allow exhaust gas to flow through the upstream side to the downstream side of the partition wall 26 in the space between the outer cylinder 13 and the inner cylinder 14. The partition wall 26 is welded on the outside of the cylindrical member 18, and is deposited on a more upstream side than the middle in the upstream-downstream direction of the silencer 12 as illustrated in FIG. 3. When the partition wall 26 is provided, particularly in relation to the cone 21, it is deposited on an immediately downstream side of a based end side of the tapered shape of the cone.

In this embodiment, also a partition wall 26A may be provided on a more downstream side than the middle in the upstream-downstream direction of the silencer 12. The structure of the partition wall 26A itself is substantially similar to the partition wall 26, and is disposed in this case on an immediately downstream side of the base end side of the tapered shape of the cone 24. Thus, the two partition walls 26 and 26A are disposed in this embodiment, and thus the space between the outer cylinder 13 and the inner cylinder 14 are partitioned into three in the upstream-downstream direction. The above-described sound absorbing material 17 is filled in each of these partitioned spaces.

Figure 6:
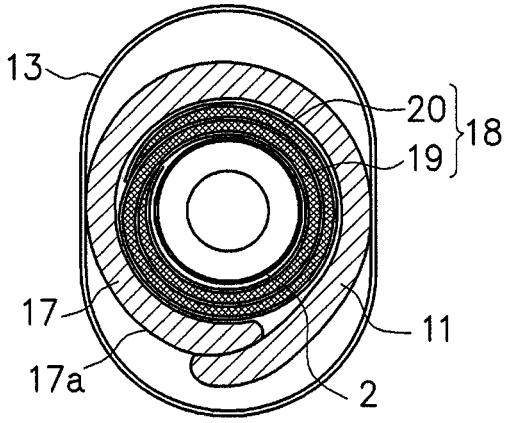
FIG. 6 is across-sectional view illustrating a state of assembling a sound absorbing material on the silencer in the exhaust device of the present invention.

Here, the sound absorbing material 17 is attached in a bagged state when being assembled with the silencer 12. For example, as illustrated in FIG. 6, the sound absorbing material 17 is stuffed in a polyester bag 17*a*. The polyester bag 17*a* melts at relatively low temperatures, and thus the glass wool of the sound absorbing material 17 expands across the space between the outer cylinder 13 and the inner cylinder 14 by heating by exhaust gas after being assembled.

Next, in the exhaust device 10 of the present invention having the above-described structure, describing the operation or the like thereof, the exhaust gas which flowed into the silencer 12 first collides with the cone body 21 in the inner cylinder 14. This cone 21 is formed to be tapered toward the upstream side as described above, and no punching hole or the like is provided therein. Thus, the flow of the exhaust gas expands in a radial direction of the inner cylinder 14, and passes through the punching holes 16 of the inner cylinder 14. Regarding the energy of the exhaust gas which passed through the punching holes 16, a sound reduction effect can be obtained while passing therethrough by pressure loss or by absorbing high-frequency sound by the sound absorbing material 17 of wrapped glass wool and the like. By employing the conical shape for the cone 21, the exhaust sound can be reduced effectively without largely increasing exhaust resistance.

Further, regarding the cone 24 disposed on the more downstream side, similarly, the energy of the exhaust gas can be reduced by making the flow of the exhaust gas to expand in the radial direction of the inner cylinder 14 and making it pass through the punching holes 16.

Figure 7:
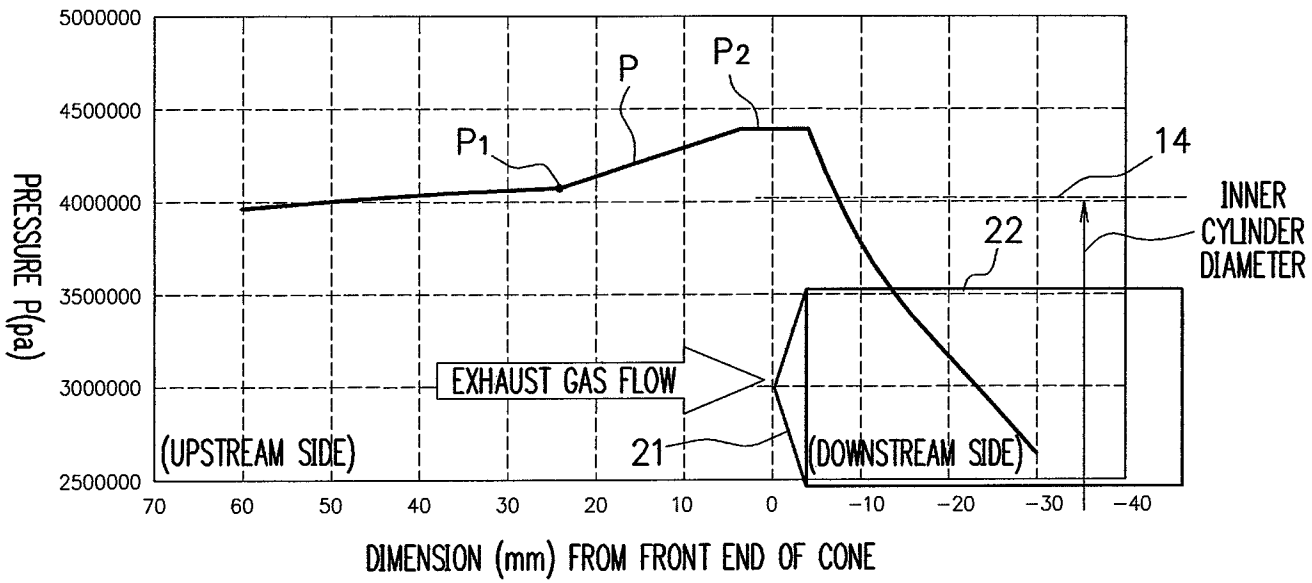
FIG. 7 is a diagram illustrating an internal Pressure distribution in the silencer when exhaust gas flows in the exhaust device of the present invention.

In the present invention, particularly the partition wall 26 and the partition wall 26A are disposed corresponding to the cone 21 and the cone 24. Here, FIG. 7 illustrates an internal pressure distribution in the silencer 12 when the exhaust gas passes through. The exhaust gas which has flowed in from the upstream side in the inner cylinder 14 collides with the cone 21 and is distributed to expand in the radial direction. By the collision of the exhaust gas with the cone 21, an internal pressure P starts to rise (internal pressure $P_1$) on the upstream side of the cone 21, and increases (internal pressure $P_2$) to peak at a position in the vicinity of the cone from the front end of the cone 21 to a more downstream side than the rear end (base end) of the cone 21, and thereafter decreases. Further, regarding the cone 24, the magnitude of the internal pressure P is relatively smaller than the case of the cone 21, but the pressure increases in the vicinity of the base end of the cone 21. FIG. 3 also illustrates such a pressure distribution in the silencer 12, where two pressure peaks appear corresponding to the cone 21 and the cone 24 as illustrated.

In the present invention, the partition wall 26 and the partition wall 26A are disposed on the immediately downstream sides of the base end sides of the tapered shapes of the cone 21 and the cone 24, respectively. As described above, when the pressure of the exhaust gas increases in the vicinity of the cone 21 and the cone 24, the glass wool forming the sound absorbing material 17 is displaced toward the downstream side by the pressure of the exhaust gas when the partition wall 26 and the partition wall 26A are absent, where the sound absorbing effect cannot be exhibited sufficiently. According to the present invention, by providing the partition wall 26 and the partition wall 26A, it is possible to prevent movement of the sound absorbing material 17 in the downstream direction. Then, by preventing displacement of the glass wool, it is possible to ensure the proper function of the sound absorbing material 17 for a long period.

In this case, the partition wall 26 and the partition wall 26A have the continuous holes 26*a* formed therein and have an effect of suppressing displacing movement of the sound absorbing material 17, but do not practically restrict or suppress the flow of the exhaust gas. Specifically, permeability of the exhaust gas between the upstream side and the downstream side of each of the partition wall 26 and the partition wall 26A before and after them is secured, and thus practically there is no influence on engine output performance by disposing the partition wall 26 and the partition wall 26A. Flowability of the exhaust gas can be maintained as it is in this manner, and thus they can be used effectively in a longitudinal direction in the upstream-downstream direction of the sound absorbing material 17 disposed along the flow thereof.

Further, the cones 21, 24 each having a tapered shape toward the upstream side are provided in the inner cylinder 14 of the silencer 12 as described above, and the partition wall 26 and the partition wall 26A are disposed corresponding to these cones. Among them, particularly the cone 21 and the partition wall 26 are disposed on the more upstream side than the middle in the upstream-downstream direction of the silencer 12. As can be seen from FIG. 3, the inside of the silencer 12 increases in pressure toward the upstream side, and thus disposing the cone 21 and the partition wall 26 on the upstream side has a large effect.

Further, the partition wall 26 and the partition wall 26A are disposed on the immediately downstream sides of the base end sides of the tapered shapes of the cone 21 and the cone 24, respectively. The silencer internal pressure increases to be highest in the vicinity of the front end portions of the cones 21, 24, and thus movement of the glass wool of the sound absorbing material 17 is easiest on the downstream sides of the front end portions of the cones 21, 24. Therefore, to prevent movement of the glass wool, it is most suitable to provide the partition walls 26, 26A on the downstream sides of the cones 21, 24.

Further, the partition walls 26, 26A are formed of wire cloths. Here, replacement of the glass wool of the sound absorbing material 17 is performed by pushing the inner cylinder 14 into the outer cylinder 13, and thus the partition walls 26, 26A are desired to be deformed to follow the shape of an inner peripheral face of the outer cylinder 13. Since the vicinities of outer peripheral portions of the partition walls 26, 26A formed of wire cloths deform moderately to follow the inner peripheral face of the outer cylinder 13, it is effective in terms of workability at a time of replacement.

As described above, in the exhaust device 10 of the present invention, since the partition walls 26, 26A of wire cloths can suppress displacement of the glass wool of the sound absorbing material 17, it is possible to use inexpensive bagged glass wool. Further, since the partition walls 26, 26A are formed with wire cloths, permeability before and after them does not decrease, and hence there is no influence on output performance. Moreover, the glass wool needs to be replaced regularly when it deteriorates due to traveling, and flexibility of the glass wool facilitates replacement work.

In the foregoing, the present invention has been described together with various embodiments, but the invention is not limited to these embodiments and modifications or the like may be made within the scope of the present invention.

For example, even when only the cone 21 and the partition wall 26 on the upstream side are provided, a predetermined effect can be obtained by them. Specifically, this is because a higher effect of the partition wall 26 to suppress displacement toward the downstream side of the sound absorbing material 17 caused by exhaust gas can be obtained on the more upstream side of the exhaust gas flow where the silencer internal pressure is high. Moreover, according to the length of the silencer 12, that is, when the silencer 12 is long, it is also possible to provide three or more partition walls.

According to the present invention, by providing the partition wall, it is possible to prevent movement of the sound absorbing material in the downstream direction. By preventing displacement of the glass wool of the sound absorbing material, it is possible to ensure the proper function of the sound absorbing material for a long period. Since the continuous holes are formed in this partition wall, permeability of exhaust gas is secured between the upstream side and the downstream side of the partition wall, and there is no practical influence on engine output performance.

What is claimed is:

1. An exhaust device of an engine, the exhaust device comprising:

an exhaust pipe connected to the engine;

a silencer connected to the exhaust pipe and structured of an outer cylinder and an inner cylinder in which plural holes are formed; and a sound absorbing material disposed in a space formed between the inner cylinder and the outer cylinder, wherein the exhaust device further comprises a partition wall partitioning the space and supporting the sound absorbing material so that the sound absorbing material does not move in an axial direction of the silencer, wherein the partition wall comprises a continuous hole allowing exhaust gas to flow through an upstream side to a downstream side of the partition wall in the space, and wherein the silencer comprises a cone tapered toward the upstream side in the inner cylinder, the cone having a closed structure.

2. The exhaust device of the engine according to claim 1, wherein at least the partition wall and the cone are disposed on a more upstream side than a middle of the silencer in an upstream-downstream direction.

3. The exhaust device of the engine according to claim 1, wherein the partition wall is disposed on an immediately downstream side of a base end side of the tapered shape of the cone.

4. The exhaust device of the engine according to claim 1, wherein the partition wall is formed of a wire cloth material.

* * * * *